US010718336B2

(12) United States Patent
Tipton

(10) Patent No.: US 10,718,336 B2
(45) Date of Patent: Jul. 21, 2020

(54) MOLD PUMP ASSEMBLY

(71) Applicant: PYROTEK, INC., Spokane, WA (US)

(72) Inventor: Jon Tipton, Aurora, OH (US)

(73) Assignee: PYROTEK, INC., Spokane, WA (US)

( * ) Notice: Subject to any disclaimer, the term of this patent is extended or adjusted under 35 U.S.C. 154(b) by 103 days.

(21) Appl. No.: 15/944,184

(22) Filed: Apr. 3, 2018

(65) Prior Publication Data

US 2018/0223853 A1 Aug. 9, 2018

Related U.S. Application Data

(62) Division of application No. 14/112,694, filed as application No. PCT/US2012/034048 on Apr. 18, 2012, now Pat. No. 9,970,442.

(60) Provisional application No. 61/476,433, filed on Apr. 18, 2011.

(51) Int. Cl.

| | |
|---|---|
| ***F04D 7/06*** | (2006.01) |
| ***F04D 7/00*** | (2006.01) |
| ***B22D 17/02*** | (2006.01) |
| ***F04D 29/047*** | (2006.01) |
| ***B22D 23/00*** | (2006.01) |
| ***B22D 39/02*** | (2006.01) |
| ***F04D 3/00*** | (2006.01) |

(52) U.S. Cl.

CPC ..... *F04D 7/00* (2013.01); *B22D 17/02* (2013.01); *B22D 23/00* (2013.01); *B22D 39/02* (2013.01); *F04D 3/005* (2013.01); *F04D 7/065* (2013.01); *F04D 29/0473* (2013.01)

(58) Field of Classification Search

CPC . F04D 7/00; F04D 3/005; F04D 7/065; F04D 29/0473; B22D 17/02; B22D 23/00; B22D 39/02

See application file for complete search history.

(56) References Cited

U.S. PATENT DOCUMENTS

| | | | | | |
|---|---|---|---|---|---|
| 4,475,866 | A * | 10/1984 | Kambe | F04D 29/047 | 415/112 |
| 5,215,141 | A * | 6/1993 | Kuhn | B22D 18/04 | 164/133 |
| 5,685,701 | A * | 11/1997 | Chandler | F04D 7/065 | 266/235 |
| 5,716,195 | A * | 2/1998 | Thut | F04D 7/065 | 417/360 |
| 2004/0115079 | A1 * | 6/2004 | Cooper | F04D 7/065 | 417/424.1 |

(Continued)

*Primary Examiner* — Aaron R Eastman
(74) *Attorney, Agent, or Firm* — Fay Sharpe LLP

(57) ABSTRACT

A molten metal pump assembly and method to fill complex molds with molten metal, such as aluminum. The pump assembly includes an elongated shaft connecting a motor to an impeller. The impeller is housed within a chamber of a base member such that rotation of the impeller draws molten metal into the chamber at an inlet and forces molten aluminum through an outlet. A first bearing is adapted to support the rotation of the impeller at a first radial edge and a second bearing adapted to support the rotation of the impeller at a second radial edge. A bypass gap is interposed between the second bearing and the second radial edge. Molten metal leaks through the bypass gap at a predetermined rate to manipulate a flow rate and a head pressure of the molten metal such that precise control of the flow rate is achieved.

11 Claims, 7 Drawing Sheets

(56) References Cited

U.S. PATENT DOCUMENTS

| | | | | |
|---|---|---|---|---|
| 2006/0198725 | A1* | 9/2006 | Thut | F04D 7/065 415/93 |
| 2008/0253905 | A1* | 10/2008 | Morando | F04D 7/065 417/321 |
| 2010/0266396 | A1* | 10/2010 | Thut | F04D 7/065 415/200 |

* cited by examiner

MOLD PUMP ASSEMBLY

This application claims priority to U.S. Ser. No. 14/112,694 filed Oct. 18, 2013, which is a National Stage filing of International Application No. PCT/US2012/034048, filed Apr. 18, 2012, which claims the benefit of U.S. Provisional Application No. 61/476,433 filed Apr. 18, 2011.

BACKGROUND

The present exemplary embodiment relates to a pump assembly to pump molten metal. It finds particular application in conjunction with a shaft and impeller assembly for variable pressure pumps for filling molds with molten metal, and will be described with particular reference thereto. However, it is to be appreciated that the present exemplary embodiment is also amenable to other like applications.

At times it is necessary to move metals in their liquid or molten form. Molten metal pumps are utilized to transfer or recirculate molten metal through a system of pipes or within a storage vessel. These pumps generally include a motor supported by a base member having a rotatable elongated shaft extending into a body of molten metal to rotate an impeller. The base member is submerged in the molten metal and includes a housing or pump chamber having the impeller located therein. The motor is supported by a platform that is rigidly attached to a plurality of structural posts or a central support tube that is attached to the base member. The plurality of structural posts and the rotatable elongated shaft extends from the motor and into the pump chamber submerged in the molten metal within which the impeller is rotated. Rotation of the impeller therein causes a directed flow of molten metal.

The impeller is mounted within the chamber in the base member and is supported by bearing rings to act as a wear resistant surface and allow smooth rotation therein. Additionally, a radial bearing surface can be provided on the elongated shaft or impeller to prevent excessive vibration of the pump assembly which could lead to inefficiency or even failure of pump components. These pumps have traditionally been referred to as centrifugal pumps.

Although centrifugal pumps operate satisfactorily to pump molten metal, they have never found acceptance as a means to fill molten metal molds. Rather, this task has been left to electromagnetic pumps, pressurized furnaces and ladeling. Known centrifugal pumps generally control a flow rate and pressure of molten metal by modulating the rotational rate of the impeller. However, this control mechanism experiences erratic control of the flow rate and pressure of molten metal when attempting to transfer molten metal into a mold such as a form mold. The erratic control of the flow of molten metal into the form mold is especially prevalent when attempting to fill a form mold for a complicated or intricately formed tool or part.

BRIEF DESCRIPTION

In one embodiment, the present disclosure relates to a molten metal pump assembly to fill molds with molten metal. The pump assembly comprises an elongated shaft connecting a motor to an impeller. The impeller is housed within a pump chamber of a base member such that rotation of the impeller draws molten metal into the chamber at an inlet and forces molten metal through an outlet of the chamber. The impeller includes a first radial edge spaced from a second radial edge such that the first radial edge is adjacent the elongated shaft. A bearing assembly surrounds the impeller within the chamber, the bearing assembly includes a first bearing adapted to support the rotation of the impeller at the first radial edge and a second bearing adapted to support the rotation of the impeller at the second radial edge. At least one bypass gap is interposed between one of the first and second bearings and the associated first and second radial edges. The bypass gap is operative to manipulate a flow rate and a head pressure of the molten metal. Molten metal leaks from the chamber through the bypass gap at a predetermined rate as the impeller is rotated such that a precise control of the flow rate is achieved.

In another embodiment of the present disclosure, a method of filling a mold with molten metal is provided. The method comprises rotating an impeller within a chamber. Molten metal is transferred through the impeller into the chamber. A predetermined portion of molten metal leaks through at least one bypass gap from the chamber to the base exterior. The leakage rate allows for precise tuning of a head pressure relative to a rotational speed of the impeller. An associated mold is filled with the molten metal and is controlled by a programmable control profile.

According to yet another embodiment of the present disclosure, a molten metal pump assembly to fill molds with molten metal is provided. The pump assembly comprises an elongated shaft connecting a motor to an impeller. The impeller is housed within a chamber of a base member such that rotation of the impeller draws molten metal into the chamber at an inlet and forces molten metal through an outlet of the chamber. The impeller includes a first radial edge adjacent to a first peripheral circumference spaced from a second radial edge adjacent to a second peripheral circumference such that the elongated shaft is rigidly attached to the first peripheral circumference.

A bearing assembly surrounds the impeller within the chamber and includes a first bearing adapted to support the rotation of the impeller at the first radial edge and a second bearing adapted to support the rotation of the impeller at the second radial edge. At least one bypass gap is provided at the second peripheral circumference to provide fluid communication between the chamber and a surrounding environment. The bypass gap is operative to allow a predetermined amount of molten metal leak from the chamber such that precise control of the flow rate and head pressure of the molten metal is provided at the outlet.

One aspect of the present disclosure is an assembly and method of use for a molten metal pump to fill complex molds such that the bypass gap allows for a more precise flow control.

DETAILED DESCRIPTION

It is to be understood that the detailed figures are for purposes of illustrating the exemplary embodiments only and are not intended to be limiting. Additionally, it will be appreciated that the drawings are not to scale and that portions of certain elements may be exaggerated for the purpose of clarity and ease of illustration.

Figure 1:
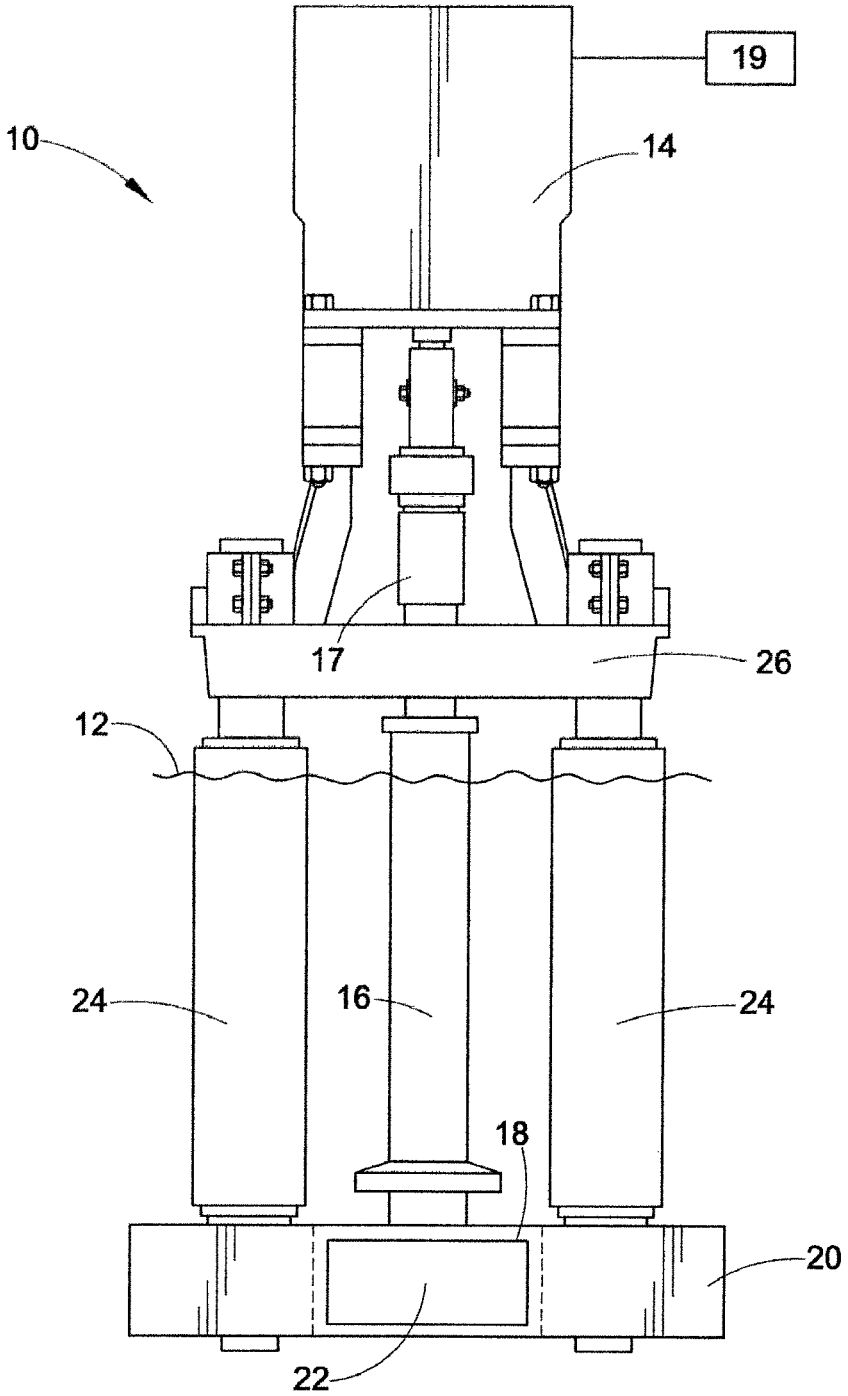
FIG. 1 (PRIOR ART)
FIG. 1 is a front view of a prior art molten metal pump assembly.
Figure 2:
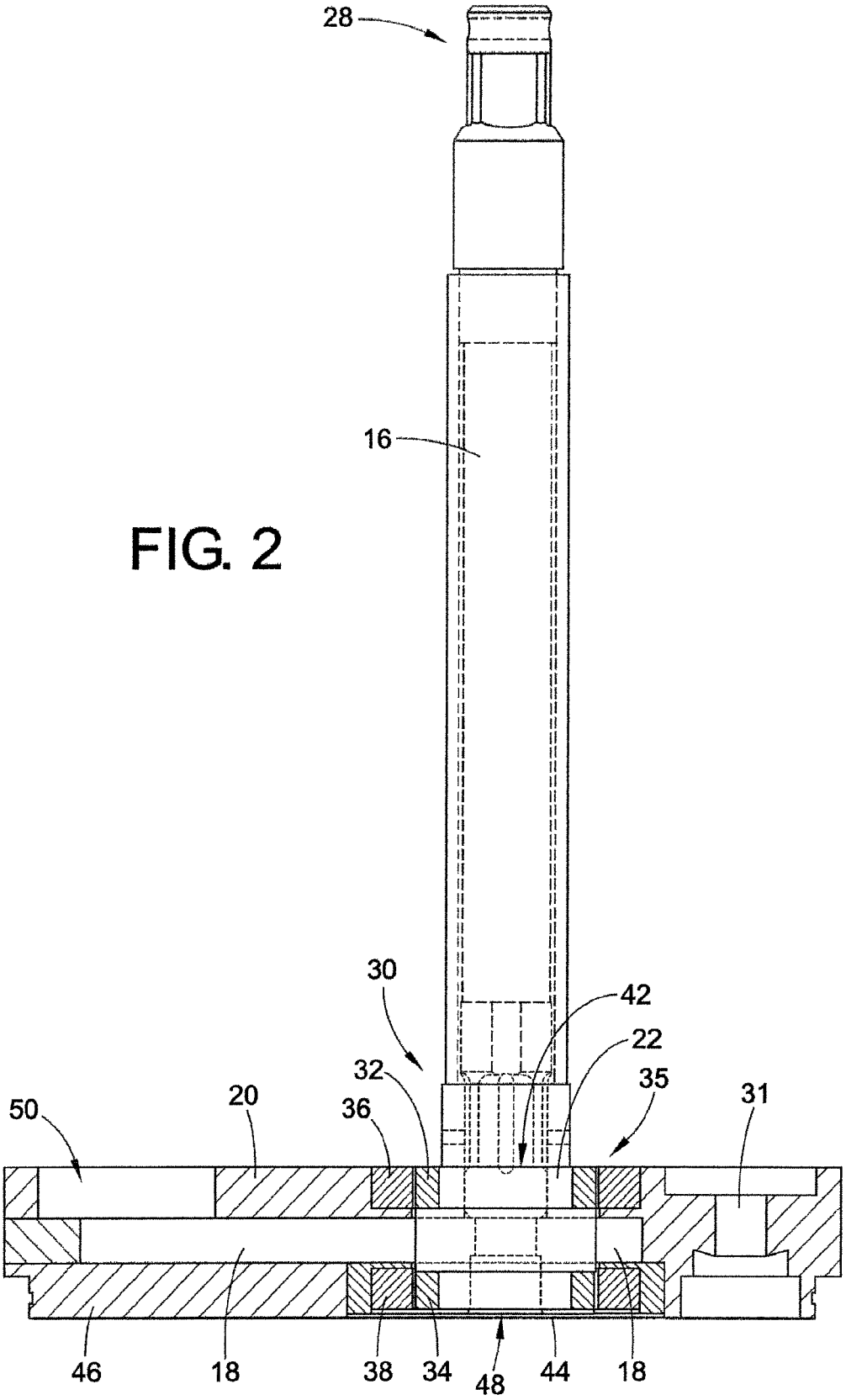
FIG. 2 is a cross sectional view of a portion of the molten metal pump assembly, the portion including an elongated shaft attached to an impeller within a chamber of a base member.
Figure 3:
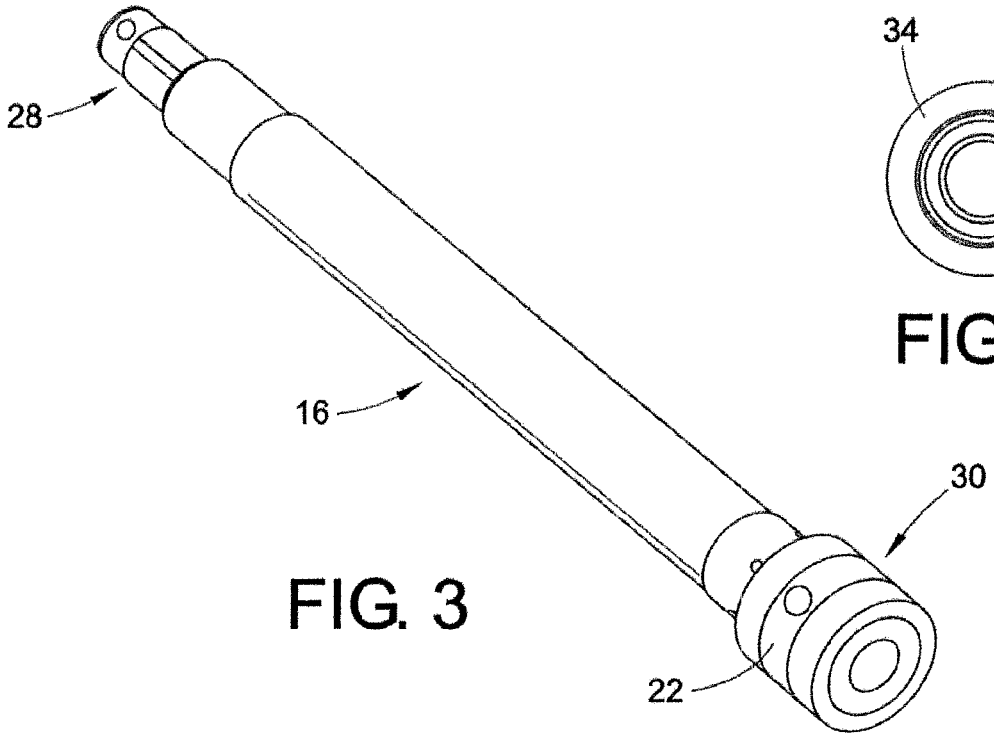
FIG. 3 is a perspective view of the elongated shaft and the impeller.
Figure 4:
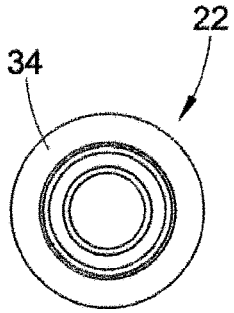
FIG. 4 is an end view of the impeller.
Figure 5:
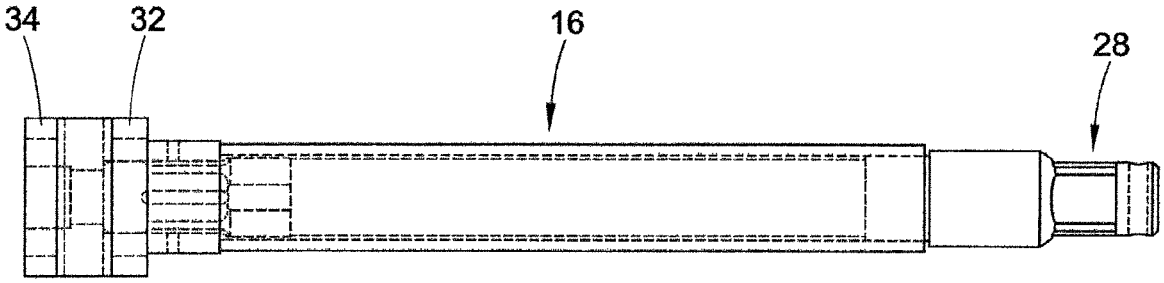
FIG. 5 is a front view of the elongated shaft.

With reference to FIG. 1, an example of a molten metal pump assembly 10 submerged in a bath of molten metal 12 is displayed. The molten metal 12, such as aluminum, can be located within a furnace or tank (not shown). The molten metal pump assembly 10 includes a motor 14 connected to an elongated shaft 16 via coupling 17. The motor is adapted to be run at variable speed by a programmable controller 19, such as a computer or other processor. The elongated shaft 16 is connected to an impeller 22 located in the chamber 18 of a base member 20. The base member 20 is suspended by a plurality of refractory posts 24 attached to a motor mount 26. An alternative form of post could also be employed wherein a steel rod surrounded by a refractory sheath extends between the motor mount and the base member 20.

The elongated shaft 16 is rotated by the motor 14 and extends from the motor 14 and into the pump chamber 18 submerged in the molten metal 12 within which the impeller 22 is rotated. Rotation of the impeller 22 therein causes a directed flow of molten metal 12 through an associated metal delivery conduit (not shown) such as a riser, adapted for fluid metal flow. The riser for the metal delivery conduit system is connected to the outlet of the pump chamber 18 which is typically adjacent a side wall or top wall of the base member. These types of pumps are often referred to as transfer pumps. An example of one suitable transfer pump is shown in U.S. Pat. No. 5,947,705, the disclosure of which is herein incorporated by reference.

With reference to FIGS. 2-6, elements of the molten metal pump assembly 10 of the present disclosure are illustrated. More particularly, the elongated shaft 16 has a cylindrical shape having a rotational axis that is generally perpendicular to the base member 20. The elongated shaft has a proximal end 28 that is adapted to attach to the motor 14 by the coupling 17 and a distal end 30 that is connected to the impeller 22. The impeller 22 is rotably positioned within the pump chamber 18 such that operation of the motor 14 rotates the elongated shaft 16 which rotates the impeller 22 within the pump chamber 18.

The base member 20 defines the pump chamber 18 that receives the impeller 22. The base member 20 is configured to structurally receive the refractory posts 24 (optionally comprised of an elongated metal rod within a protective refractory sheath) within passages 31. Each passage 31 is adapted to receive the metal rod component of the refractory post 24 to rigidly attach to a motor mount 26. The motor mount 26 supports the motor 14 above the molten metal 12.

In one embodiment, the impeller 22 is configured with a first radial edge 32 that is axially spaced from a second radial edge 34. The first and second radial edges 32, 34 are located peripherally about the circumference of the impeller 22. The pump chamber 18 includes a bearing assembly 35 having a first bearing ring 36 axially spaced from a second bearing ring 38. The first radial edge 32 is facially aligned with the first bearing ring 36 and the second radial edge 34 is facially aligned with the second bearing ring 38. The bearing rings are made of a material, such as silicon carbide, having frictional bearing properties at high temperatures to prevent cyclic failure due to high frictional forces. The bearings are adapted to support the rotation of the impeller 22 within the base member such that the pump assembly 10 is at least substantially prevented from vibrating. The radial edges of the impeller may similarly be comprised of a material such as silicon carbide. For example, the radial edges of the impeller 22 may be comprised of a silicon carbide bearing ring.

In one embodiment, the impeller 22 includes a first peripheral circumference 42 axially spaced from a second peripheral circumference 44. The elongated shaft 16 is attached to the impeller 22 at the first peripheral circumference 42. The second peripheral circumference 44 is spaced opposite from the first peripheral circumference 44 and aligned with a bottom portion 46 of the base member 20. The first radial edge 32 is adjacent to the first peripheral circumference 42 and the second radial edge 34 is adjacent to the second peripheral circumference 44.

In one embodiment, a bottom inlet 48 is provided in the second peripheral circumference 44. More particularly, the inlet comprises the annulus of a bird cage style of impeller 22. Of course, the inlet can be formed of vanes, bores, annulus ("bird cage") or other assemblies known in the art. It is noted that a top feed pump assembly or a combination top and bottom feed pump assembly may also be used.

As will be apparent from the following discussion, a bored or bird cage impeller may be advantageous because they include a defined radial edge allowing a designed tolerance (or bypass gap) to be created with the pump chamber 18. An example of a bored impeller is provided by U.S. Pat. No. 6,464,458, the disclosure of which is herein incorporated by reference.

The rotation of the impeller 22 draws molten metal 12 into the inlet 48 and into the chamber 18 such that continued rotation of the impeller 22 causes molten metal 12 to be forced out of the pump chamber 18 to an outlet 50 of the base member 20.

Figure 6:
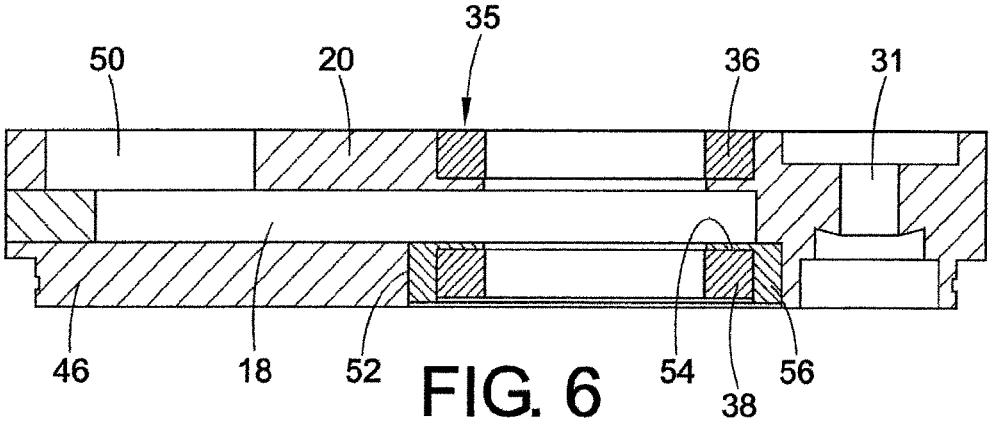
FIG. 6 is a cross sectional view of the base member.

With reference to FIG. 6, the bearing assembly 35 includes a base ring bearing adapter 52 that is configured to connect the second bearing ring 38 to the bottom portion 46 of the base member 20. The base ring bearing adapter 52 includes a radial flange portion 54 that is rigidly attached to a disk body 56 and is operative to support bearing rings of various sizes along the bottom portion 46 of the base member 20. The radial flange portion 54 is adjacent the pump chamber 18 and is generally perpendicular to the disk body 56.

Figure 7:
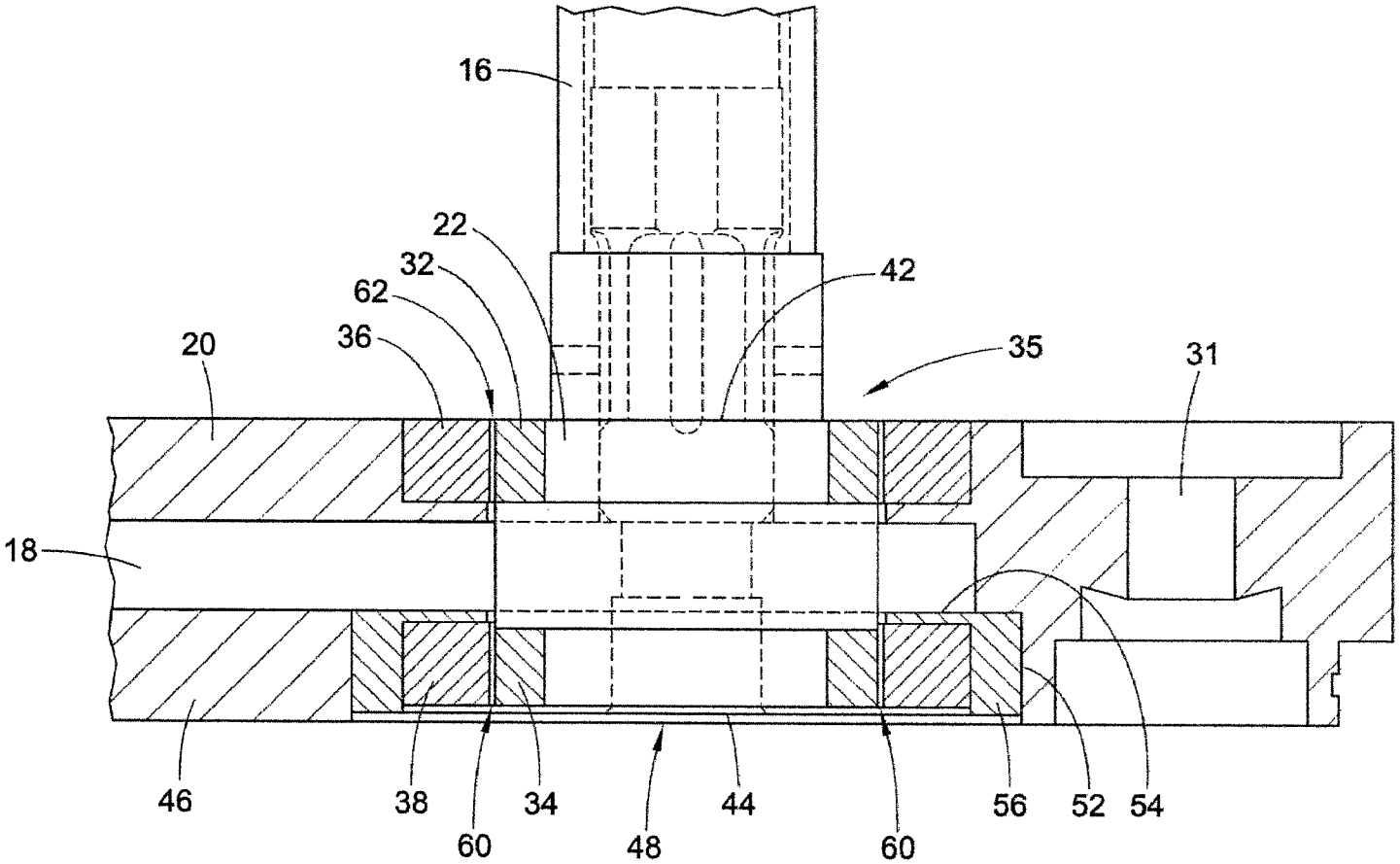
FIG. 7 is an exploded cross sectional view of the elongated shaft attached to the impeller within the chamber of the base member illustrated in FIG. 2.

FIG. 7 illustrates the impeller 22 located within the base member 20. A close tolerance is maintained between radial edge 32 of the impeller 22 and the first bearing ring 36 to provide rotational and structural support to the impeller 22 within the chamber 18. The base ring bearing adapter 52 is generally circular and is configured for receiving the second bearing ring 38. Base ring bearing adapter 52 and bearing rings of different sizes can be provided at the base member to interact with the impeller 22 such that a bypass gap 60 of a desired size is provided between the bearing ring 38 and the radial edge 34 of impeller 22. Optionally, it is contemplated that the bypass gap 60 may be provided between the first radial edge 32 and the first bearing ring 36.

In one embodiment, the bypass gap 60 is interposed between a portion of the second bearing ring 38 and the second radial edge 34. For example, the bypass gap 60 is a radial space interposed between at least a portion of the second bearing 38 and the second radial edge 34 of the impeller 22. The radial space is of a designed tolerance that can be varied to allow for a predetermined leakage rate of the molten metal 12.

In this regard, it is noted that a lubrication gap 62 exists between the radial edge 32 of the impeller 22 and the bearing ring 36 disposed within the base 20. The lubrication gap is a space provided within which molten metal is retained to provide a low friction boundary. The lubrication gap can vary based upon the constituents of the relevant alloy. It is contemplated that the bypass gap will have a width (i.e. a distance between the impeller and the base) of at least about 1.25× the lubrication gap, or between about 1.5 and 6× the lubrication gap, or between about 2 and 4× the lubrication gap or any combination of such ranges.

It is also noted that a discontinuous gap width may be employed wherein relatively close tolerance regions are interspersed with relatively large bypass gap width regions.

For example, the bypass gap 60 may be a plurality of removable segmented teeth or posts that are radially positioned about the perimeter of the impeller 22 such that a plurality of teeth maintain contact with bearing ring 38 during rotation of the impeller 22 while radial spaces interposed between the teeth are configured to allow leakage of the molten metal 12 at a predetermined rate. In another embodiment, the bypass gap 60 may be provided by a plurality of apertures located through the first peripheral circumference 42 of the impeller to 22 allow fluid communication with the chamber 18 and an environment outside the base member. Further, it is contemplated that at least one bypass gap can also be provided downstream of the impeller 22 within the pump chamber 18 adjacent to outlet 50 or can even be located within the riser. This type of bypass gap can be comprised of a hole(s) drilled into a pump assembly component. In short, it is feasible to provide a molten metal pump that is functional in filling complex molds by providing a designed leakage path at any point in the pump assembly.

The bypass gap 60 is operative to manipulate a flow rate and a head pressure of the molten metal 12. The bypass gap 60 allows molten metal to leak from the pump chamber 18 to an environment outside of the base member 20 at a predetermined rate. The leakage of molten metal 12 from the pump chamber 18 during the operation of the pump assembly 10 allows an associated user to finely tune the flow rate or volumetric amount of molten metal 12 provided to an associated mold. The leakage rate of molten metal 12 through the bypass gap 60 improves the controllability of the transport of molten metal 12 and is at least in part, due to a viscosity coefficient of the molten metal 12. Namely, in one embodiment, as the viscosity of the molten metal 12 decreases, a size of the bypass gap 60 would also be decreased to get the optimal leakage rate of molten metal 12.

In one embodiment, the bypass gap 60 is provided by the second bearing ring 38 such that the second bearing ring 38 includes a larger inner diameter than the first bearing ring 36 in the bearing assembly 35. In this regard, there is a greater space between said radial edge 34 and second bearing ring 38. In another embodiment, the bypass gap 60 is provided by the impeller 22 such that the second radial edge 34 of the impeller 22 has a smaller diameter than the first radial edge 32. Here, the first radial edge 32 is abuttingly positioned and ratably supported at the first bearing ring 36 within the pump chamber 18 to form the relatively narrower lubrication gap while a bypass gap exists between the second bearing ring 38 and the second radial edge 34. Of course, a top side gap can be created by reversing the dimensions disclosed above.

Figure 8:
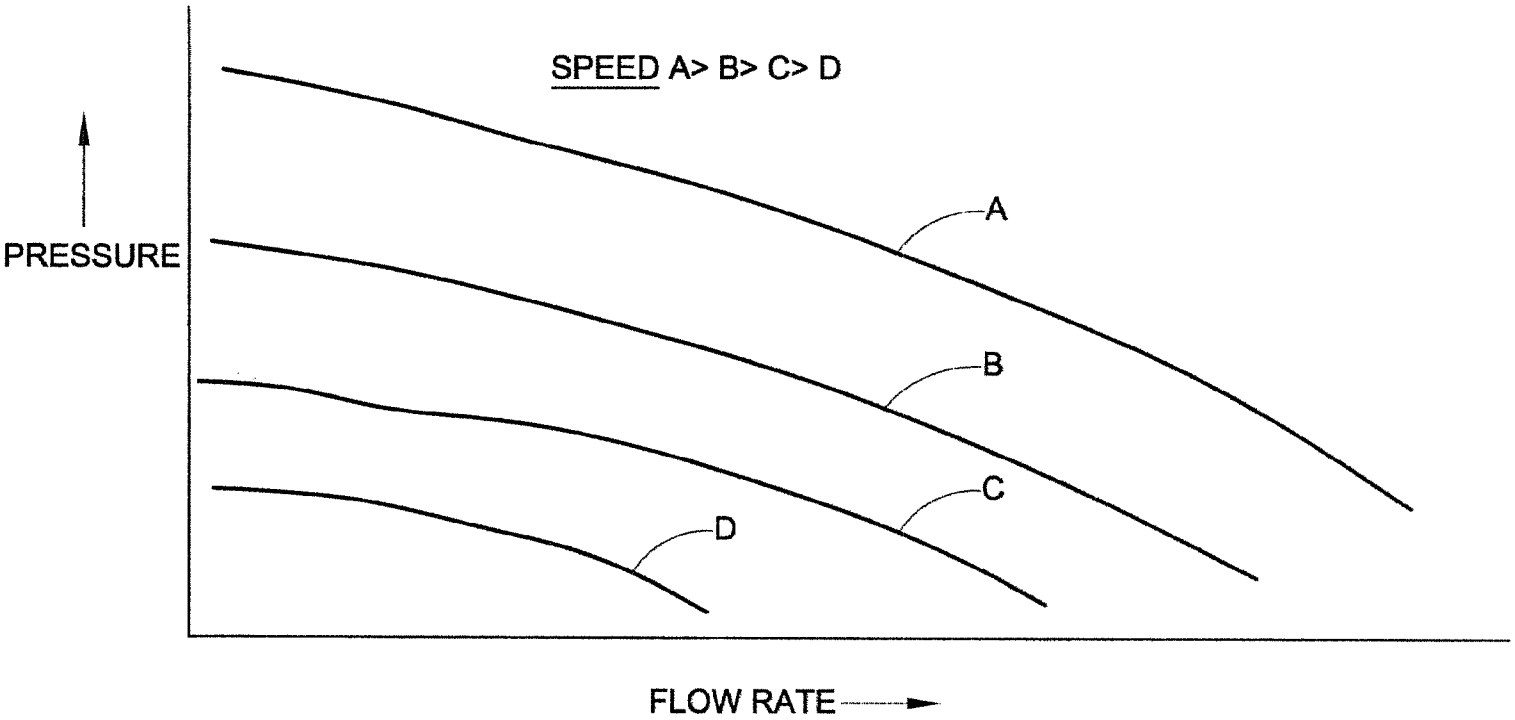
FIG. 8 is a graph indicating the relationship between molten metal pressure at an outlet and a molten metal flow rate relative to the rotations per minute (RPM) of the impeller of the pump assembly.

In one embodiment, the pump assembly includes an ability to statically position molten metal 12 pumped through the outlet 50 and into a riser at approximately 1.5 feet of head pressure above a body of molten metal 12. In one embodiment the impeller rotates approximately 850-1000 rotations per minute such that molten metal is statically held at approximately 1.5 feet above the body of molten metal 12. The bypass gap 60 manipulates the volumetric flow rate and head pressure relationship of the pump 10 such that an increased amount of rotations per minute of the impeller 22 would allow the reduction of head pressure as the flow rate of molten metal 12 is increased. This relationship as schematically illustrated by the graph in FIG. 8.

Figure 9:
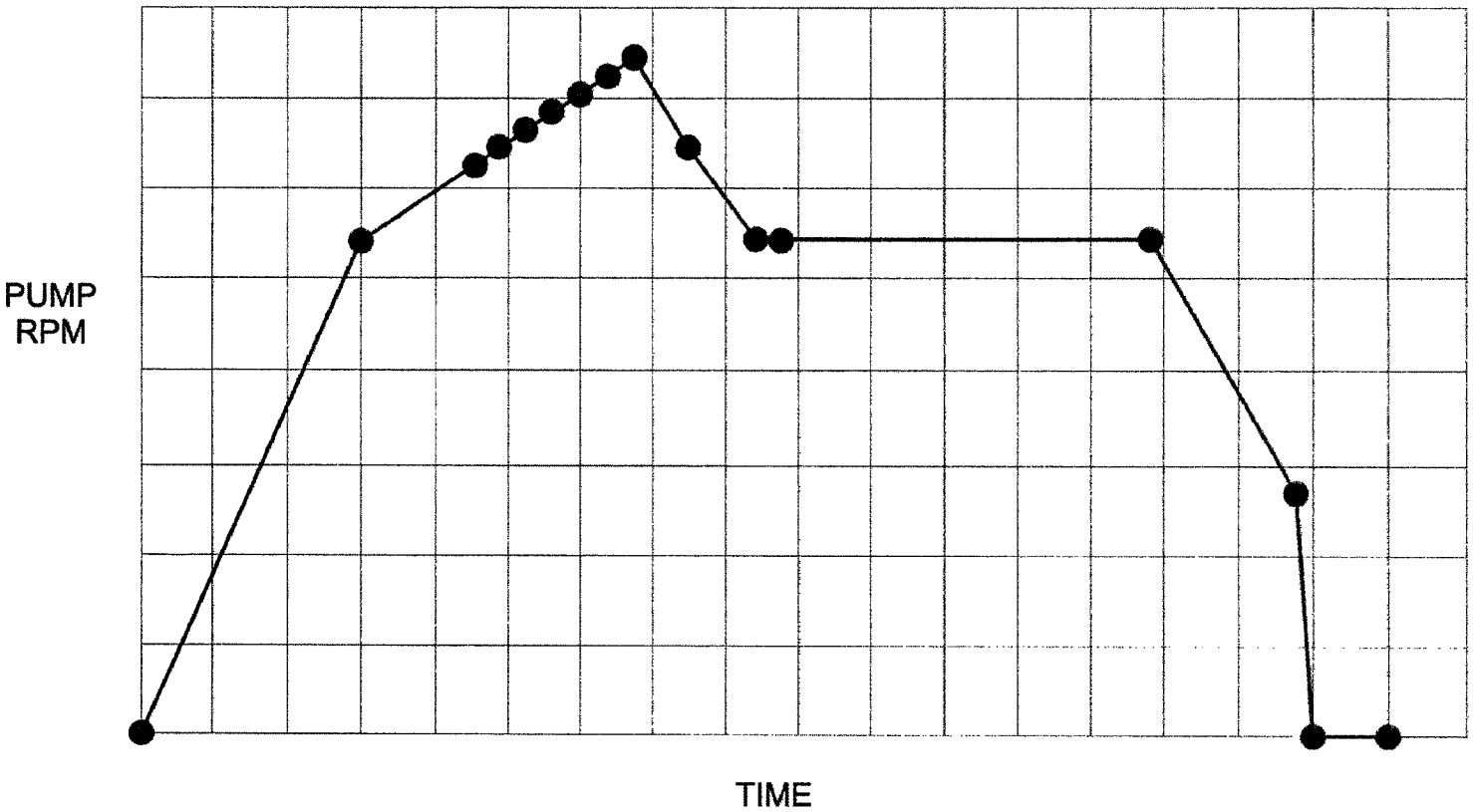
FIG. 9 is a graph indicating an exemplary relationship between RPM and time related to a programmable mold fill profile.

Precise control to the amount of molten metal 12 provided to an associated mold is achieved by positioning the bypass gap 60 between the bearing assembly 35 and the impeller 22. More particularly, in one embodiment, the motor 14 is operated by a programmable command rpm profile as illustrated by FIG. 9. A command RPM profile is programmed into a controller to electrically communicate with the motor to rotate the impeller and force molten metal through the outlet 50 and into the metal delivery conduit such that the outlet of the metal delivery conduit is adapted to an associated mold. The programmable command RPM profile varies a signal to the motor in relation to the volumetric fill rate and geometry of the associated mold.

Figure 10:
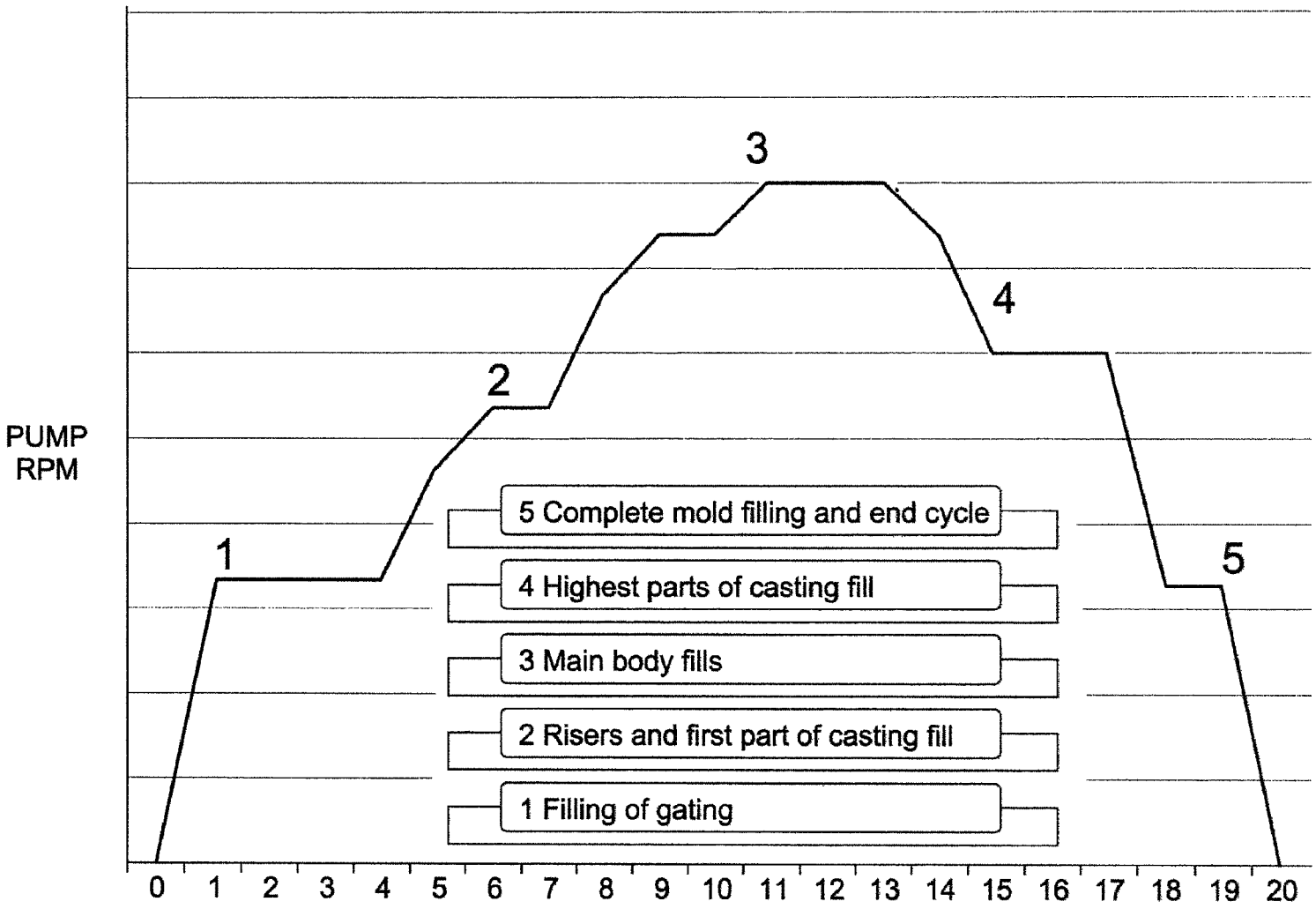
FIG. 10 is a graph of an exemplary programmable mold fill profile associated with a complicated mold.

With reference to FIG. 10, in one embodiment, an associated mold (not shown) includes a generally complex geometric area or riser to be filled by molten metal 12 such as aluminum. The metal delivery conduit or riser (not shown) is adapted to fill the associated mold with aluminum from the pump assembly 10. The pump assembly 10 is programmed with a command RPM profile, as illustrated in FIG. 10, that is associated with the inner geometric volume of the associated mold. This profile controls a command voltage at the motor 14 to rotate the impeller 12 at a predetermined rotational rate to fill the associated mold in accordance with form mold limits 1-5 at predetermined times. More particularly, the bypass gap 60 allows an increase in the magnitude of command RPM required to provide the necessary head pressure of molten metal 12 to the associated mold. This assembly and method is advantageous when filling associated molds to form complex parts within molds with a complicated geometric arrangement as finer tuning of an amount of molten metal 12 provided by the pump assembly 10 is achieved. Examples of molded parts suitable for casting using the pump assembly disclosed herein include, but are not limited to, engine blocks, wheels and cylinder heads.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molten metal pump assembly to fill a mold with molten metal, the pump assembly comprising:

an elongated shaft connecting a motor to an impeller, the impeller being housed within a chamber of a base member such that rotation of the impeller draws molten metal into the chamber at an inlet and forces molten metal through an outlet of the chamber, the impeller including a first radial edge spaced from a second radial edge such that the first radial edge is proximate the elongated shaft; and a bearing assembly surrounding the impeller within the chamber, the bearing assembly including:

a first bearing adapted to support the rotation of the impeller at the first radial edge;

a second bearing adapted to support the rotation of the impeller at the second radial edge; and wherein at least one of the first and second bearings and the associated first and second radial edges is comprised of a plurality of posts positioned radially about a perimeter of the impeller, said posts defining apertures between the posts, said apertures allowing fluid communication between the chamber and an environment external to the pump, and wherein molten metal leaks through the apertures when the impeller is rotated to manipulate a flow rate and a head pressure of the molten metal passing through the outlet of the chamber.

2. The molten metal pump in accordance with claim 1, wherein molten metal leaks from the chamber through the apertures at a predetermined rate as the impeller is rotated.

3. The molten metal pump in accordance with claim 1, wherein the apertures are only between the second bearing and second radial edge.

4. The molten metal pump in accordance with claim 1, wherein the base member is adapted to support the impeller, elongated shaft and the motor such that a second peripheral circumference of the impeller is adjacent to the second radial edge and is generally aligned with a bottom portion of the base member.

5. The molten metal pump in accordance with claim 1, wherein the impeller includes a first peripheral circumference and a second peripheral circumference such that the elongated shaft is generally perpendicular to the first peripheral circumference of the impeller.

6. The molten metal pump in accordance with claim 5, wherein the inlet is located at the first peripheral circumference, the inlet includes a plurality of apertures adapted to communicate molten metal to the chamber.

7. The molten metal pump in accordance with claim 6, wherein said impeller comprises a plurality of bores extending from said first peripheral circumference to a side wall of the impeller.

8. The molten metal pump in accordance with claim 1, wherein the molten metal leaking through the apertures reduces a head pressure of the associated molten metal at the outlet as the rotational rate of the impeller is increased.

9. A method of filling a mold with molten metal, the method comprising:

disposing the molten metal pump assembly of claim 1 in a bath of molten metal;

rotating the impeller;

transferring molten material through the impeller into the chamber;

leaking a predetermined portion of molten metal through the apertures to tune a head pressure relative to a rotational speed of the impeller; and filling an associated mold with the molten metal.

10. The method of filling a mold with molten metal according to claim 9, further comprises adjusting the rotational speed of the impeller while the associated mold is filled with molten metal.

11. The method of filling a mold with molten metal according to claim 9, further comprising controlling a head pressure and flow rate of molten metal according to a programmable mold fill profile while the associated mold is filled with the molten metal.

* * * * *